US006799997B2

(12) United States Patent
Lin et al.

(10) Patent No.: US 6,799,997 B2
(45) Date of Patent: Oct. 5, 2004

(54) CABLE END CONNECTOR ASSEMBLY WITH IMPROVED GROUNDING MEANS

(75) Inventors: Hsien-Chu Lin, Tu-Chen (TW); Chieh Chao Yu, Tu-Chen (TW); Yung-Chien Chung, Tu-Chen (TW); Chih-Kai Huang, Tu-Chjen (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 10/346,754

(22) Filed: Jan. 16, 2003

(65) Prior Publication Data

US 2004/0127099 A1 Jul. 1, 2004

(30) Foreign Application Priority Data

Dec. 25, 2002 (TW) ..... 91221051 U

(51) Int. Cl.[7] ..... H01R 9/03
(52) U.S. Cl. ..... 439/610; 439/497
(58) Field of Search ..... 439/607–610, 439/701, 497, 579, 98; 174/75 C, 74 R, 78, 88 C

(56) References Cited

U.S. PATENT DOCUMENTS 5,125,854 A * 6/1992 Bassler et al. ..... 439/607
5,244,415 A * 9/1993 Marsilio et al. ..... 439/610
5,266,053 A * 11/1993 Jamet et al. ..... 439/607
5,387,130 A * 2/1995 Fedder et al. ..... 439/610
5,709,569 A * 1/1998 Buck et al. ..... 439/607
5,885,103 A * 3/1999 Ernolf et al. ..... 439/579
6,146,196 A * 11/2000 Burger et al. ..... 439/578
6,206,731 B1 * 3/2001 Kuo ..... 439/610
6,210,216 B1 * 4/2001 Tso-Chin et al. ..... 439/545
6,213,812 B1 * 4/2001 Kan ..... 439/607
6,296,518 B1 * 10/2001 Avery et al. ..... 439/541.5
6,305,986 B1 * 10/2001 Hwang ..... 439/610
6,346,009 B1 * 2/2002 Lin ..... 439/607

FOREIGN PATENT DOCUMENTS

TW 330735 4/1998
TW 349660 1/1999

* cited by examiner

*Primary Examiner*—Tho D. Ta
*Assistant Examiner*—Larisa Tsukerman
(74) *Attorney, Agent, or Firm*—Wei Te Chung

(57) ABSTRACT

A cable end connector assembly (1) includes a plurality of electrical connectors (10), a plurality of cables (20), an insulative cover (40), and a conductor (30). Each electrical connector includes an insulative housing (11), a plurality of contacts (12) mounted in the insulative housing, and a metal shield (131, 132) assembled to the insulative housing. The cable includes a plurality of wires (21) electrically connecting with the contacts and a metal braid having a plurality of outstretched wires (22) electrically connecting with corresponding metal shield. The insulative cover is over-molded with the electrical connectors and one end of the cable. The conductor electrically and mechanically connects with the metal shields of the electrical connectors.

13 Claims, 6 Drawing Sheets

CABLE END CONNECTOR ASSEMBLY WITH IMPROVED GROUNDING MEANS

CROSS-REFERENCE TO RELATED APPLICATION

This patent application is a co-pending application of U.S. patent application Ser. No. 10/328,793, filed on Dec. 23, 2002, invented by Lin, Hsien-chu, Yu, Chieh-chao, and Chung, Yang-chien entitled "CABLE END CONNECOTR ASSEMBLY WITH IMPROVED GROUNDING MEANS" and assigned to the same assignee as this patent application.

BACKGROUND OF THE INVENTION

1. Field of the Invention

The present invention relates to a cable end connector assembly, and particularly to a cable end connector assembly having enhanced grounding effect.

2. Description of Related Art

With the developing trend of miniature of a personal computer, the integration command of a mother board is higher and higher and a plurality of electrical components is needed to be integrated thereon. Because of the limited space of a chassis of the computer, the size of the mother board is limited correspondingly, therefore, the number of the electrical components is restricted. However, with the development of consuming products, besides outer peripheral devices (such as a keyboard, a mouse et al.), the computer also needs to connect with other consuming products, such as a printer, a digital camera, a scanner, and a personal digital assistant. (PDA). This needs a lot of input/output ports settled on a panel of the chassis to satisfy the current requirement.

Under such condition, a cable end connector assembly mounted in the chassis of the computer is developed. The cable end connector assembly interconnects the input/output ports settled on the panel and corresponding electrical connectors mounted on the mother board; thus, economizing the mother board to a great extent. Such prior art cable end connector assembly is disclosed in Taiwan patent No. 330735 issued on Apr. 21, 1998 and Taiwan patent No. 349660 issued on Jan. 1, 1999. Now referring to FIG. 1, such a cable end connector assembly 90 comprises an insulative cover 91 and a plurality of electrical connectors 92 respectively received in receiving cavities defined in the cover 91. The insulative cover 91 is fastened to a grounding plate 94 by means of a pair of screws 93 and a metal shield 95 of each electrical connector 92 abuts against the grounding plate 94. The grounding plate 94 is assembled to a chassis of a computer; thus, an electrical grounding trace is established from the cable end connector assembly 90 to the computer via the grounding plate 94 and the noise generated by EMI or cross-talk is decreased.

However, the grounding effect is not reliable. Since the electrical connectors 92 abut against the grounding plate 94 by the engagement between the insulative cover 91 and the grounding plate 94, and since the material of the insulative cover 91 is relatively flexible, the electrical connectors 92 have great possibility of separating from the grounding plate 94 after frequently pull/insert from/into a complementary connector. Because of the unstable engagement between the electrical connectors 92 and the grounding plate 94, noises generated in the cable end connector assembly 90 cannot be transmitted away and a signal transmission of the cable end connector assembly 90 is influenced inevitably.

A way of fastening the electrical connectors 92 directly to the grounding plate 94 through increasing a front size of each connector can solve the above problem. However, this increases manufacturing cost, and the assembly and disassembly between the cable end connector assembly 90 and the grounding plate 94 is inconvenient. Hence, a cable end connector assembly with an improved grounding means for achieving enhanced grounding effect is required to overcome the disadvantages of the related art.

SUMMARY OF THE INVENTION

An object of the present invention is to provide a cable end connector assembly, which has a multi-way grounding trace for achieving an improved grounding performance and enhanced EMI protection.

In order to achieve the objects set forth, a cable end connector assembly comprises a plurality of electrical connectors, a cable, an insulative cover, and a conductor. Each electrical connector comprises an insulative housing, a plurality of contacts mounted in the insulative housing, and a metal shield assembled to the insulative housing. The cable comprises a plurality of wires electrically connecting with the contacts and a grounding medium electrically connecting with corresponding metal shield. The insulative cover encloses the electrical connectors and one end of the cable. The conductor electrically and mechanically connects with the metal shields of the electrical connectors.

Other objects, advantages and novel features of the invention will become more apparent from the following detailed description when taken in conjunction with the accompanying drawings.

DETAILED DESCRIPTION OF THE INVENTION

Figure 1:
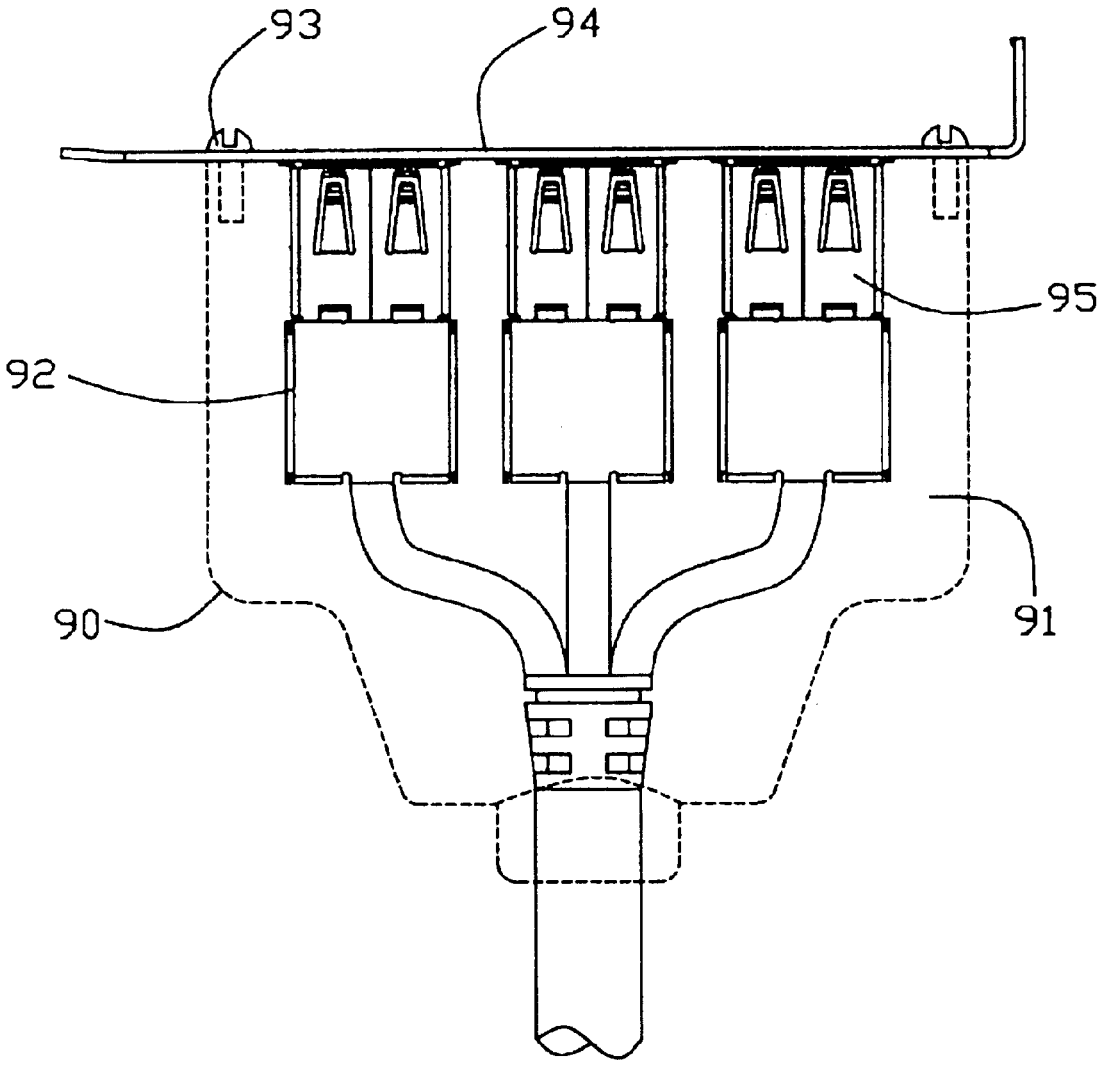
FIG. 1 is a top plan view of a conventional cable end connector assembly with a cover thereof in a perspective view.
Figure 2:
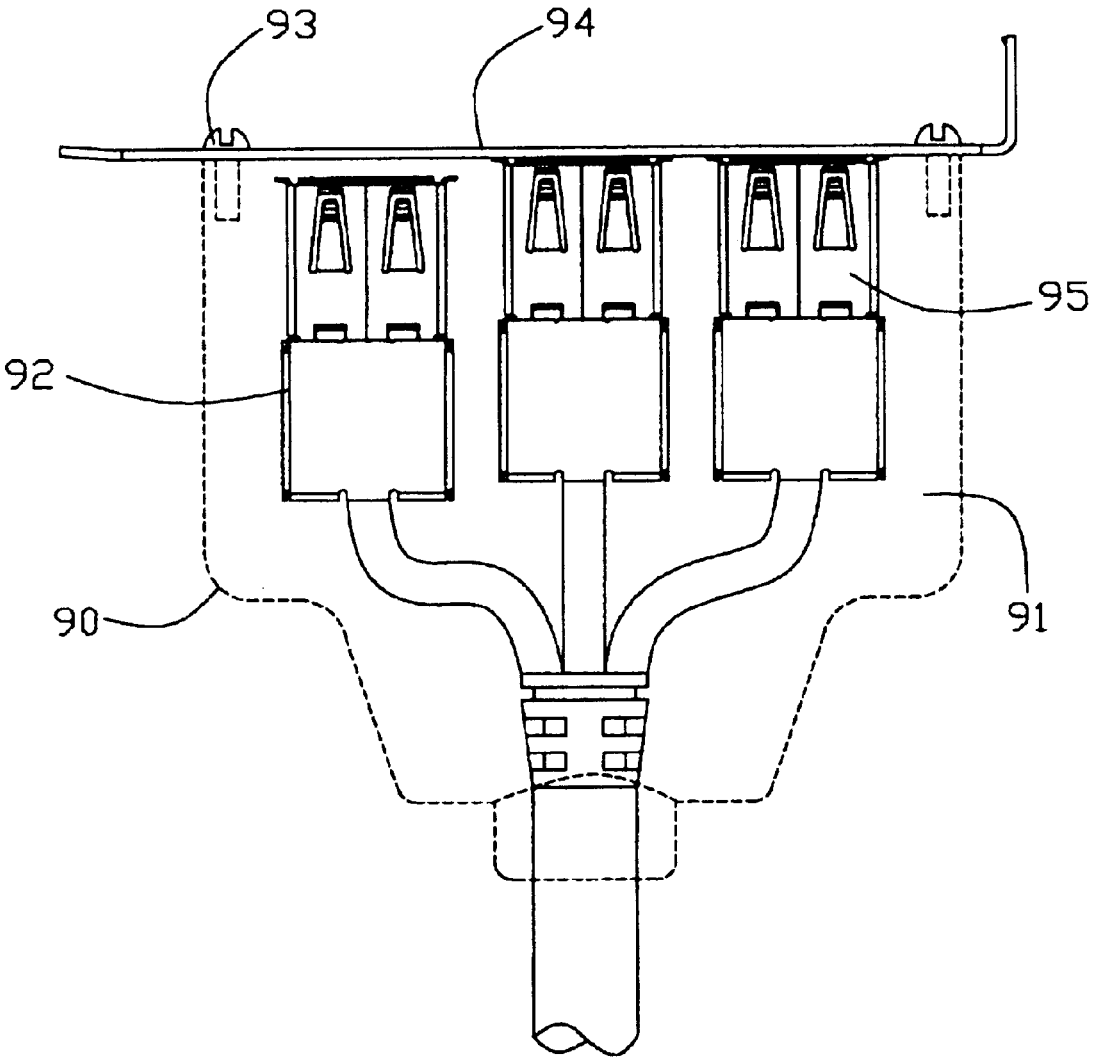
FIG. 2 is a view similar to FIG. 1 with an electrical connector thereof being not touched a grounding plate.
Figure 3:
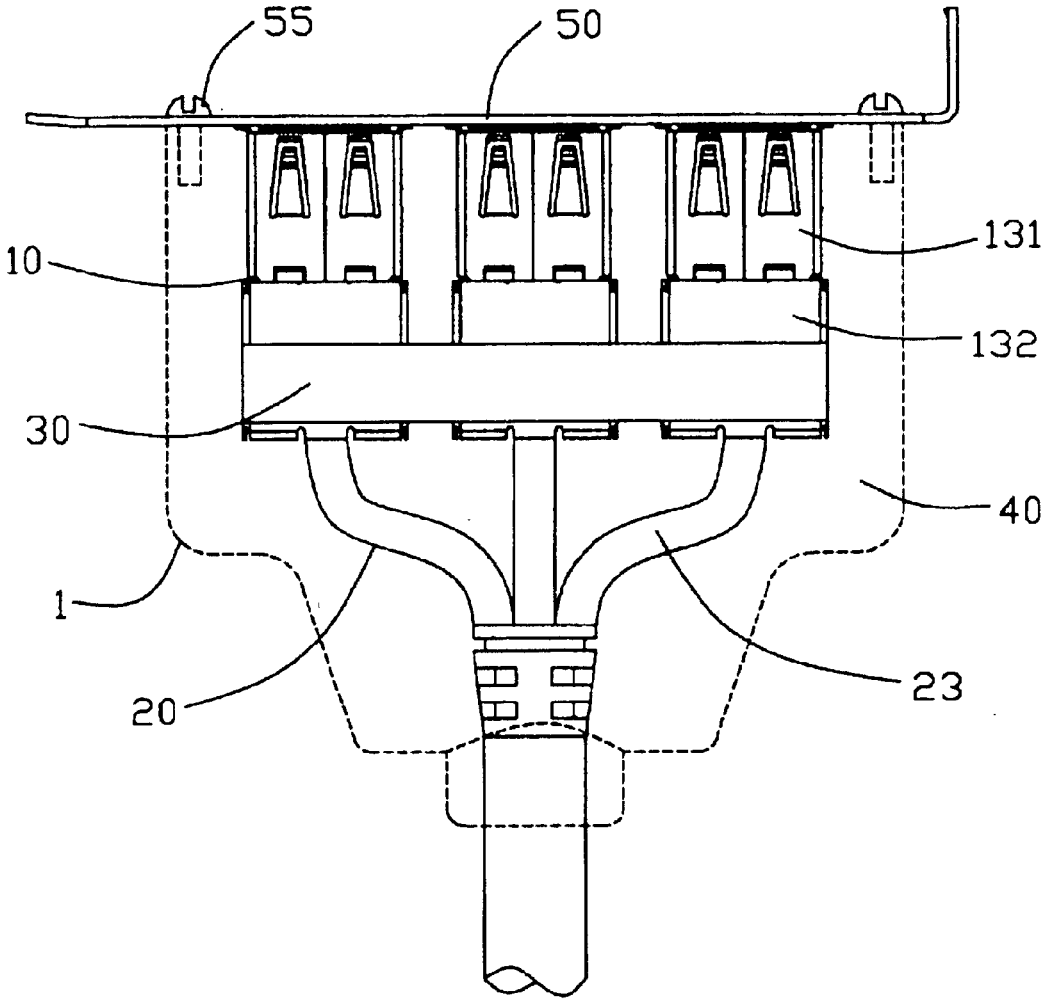
FIG. 3 is a top plan view of a cable end connector assembly in accordance with the present invention with a cover thereof in a perspective view.

Referring to FIG. 3, a cable end connector assembly 1 in accordance with the present invention comprises a plurality of cable end connectors 10, a plurality of cables 20, a conductor 30, and an insulative cover 40. A grounding plate 50 is mounted adjacent to a mating surface of the cable end connector assembly 1.

Figure 4:
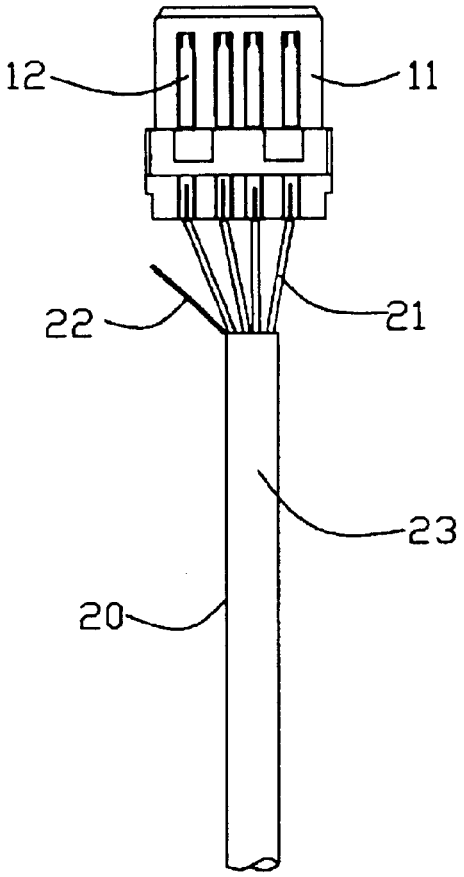
FIG. 4 is a top plan view illustrating the connection between a cable end connector and a cable, with signal wires of the cable soldered with contacts of the connector, respectively.
Figure 5:
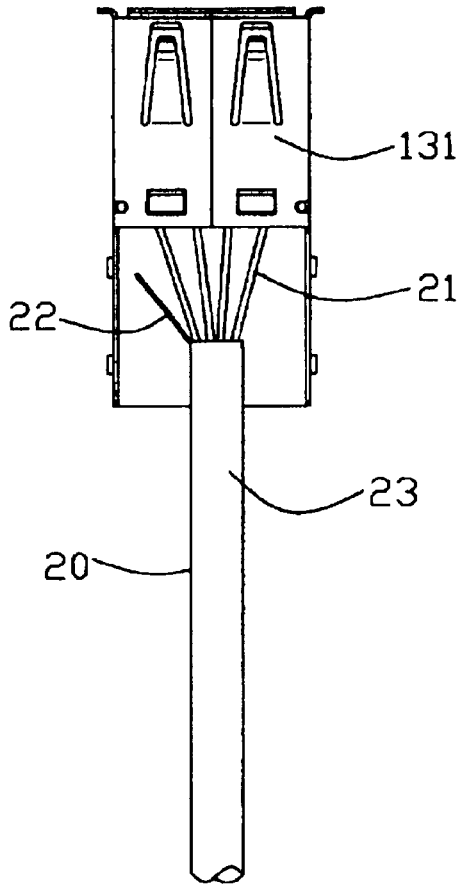
FIG. 5 is a view similar to FIG. 4 with a metal braid of the cable soldered with a metal shield of the connector.

In this embodiment shown, the plurality of cable end connectors 10 are three Universal Serial Bus (USB) connectors. In conjunction with FIGS. 4 and 5, each cable end connector 10 comprises an insulative housing 11, a plurality of contacts 12 respectively received in passageways defined in the housing 11, a first metal shield 131 enclosing the insulative housing 11 and defining a mating portion (not shown) in a front portion thereof for receiving a mating plug (not shown), and a second metal shield 132 assembled to a rear portion of the first metal shield 131.

The cables 20 respectively connect with the cable end connectors 10 and each cable 20 comprises a plurality of wires 21 for transmitting signals, an outer insulative jacket 23 surrounding the wires 21, and a metal braid positioned between the wires 21 and the outer insulative jacket 23. The metal braid is composed of a plurality of bare wires. A plurality of outstretched wires 22 stretches from the metal braid. The signal wires 21 electrically connect the contacts 12 of the cable end connectors 10 and the outstretched wires 22 are soldered on inner surfaces of the rear portion of the first metal shields 131 of the cable end connectors 10, respectively. In this embodiment shown, the outstretched wires 22 are bare wires. In alternative embodiments, the outstretched wires 22 can be surrounded by outer insulative jackets with skinned front ends thereof exposed outwardly.

The insulative cover 40 is preferably comprised of molded plastic or polymer material and over molded with the cable end connectors 10 and front ends of the cables 20. A front surface of the insulative cover 40 is substantially coplanar with front surfaces of the first metal shields 131. In alternative embodiments, the insulative cover 40 can also be a pair of covers fastened with each other by a plurality of screws.

The grounding plate 50 is long and narrow, and assembled to the front surface of the insulative cover 40. A plurality of rectangular openings (not shown) is defined in the grounding plate 50 and aligns with the mating portions of the first metal shields 131 of the cable end connectors 10 for providing the mating portions extending therethrough. The grounding plate 50 also defines a plurality of holes (not shown) therein. A plurality of screws 55 protrudes through the holes and respectively screws with thread holes defined in the insulative cover 40 for fastening the grounding plate 50 to insulative cover 40 tightly. Meanwhile, the front surfaces of the first metal shields 131 abut against the grounding plate 50. In addition, the first metal shield 131 electrically connects with corresponding cable 20 by soldering with the outstretched wires 22, therefore, an electrical grounding trace is established from the grounding plate 50 to each electrical connector 10 and corresponding cable 20. The noises generated in the electrical connectors 10 are transmitted out of the cable end connector assembly 1 via the grounding plate 50.

The conductor 30 is made of conductive material. In this embodiment shown, the conductor 30 is made of copper foil and is in the shape of a long belt. Referring to FIG. 3, a pair of opposite ends and a middle of the conductor 30 are soldered with the second metal shields 132 of the three electrical connectors 10, respectively. Thus, the first and second metal shields 131, 132 of different connectors 10 electrically connect with each other. A multi-way grounding trace is established in the cable end connector assembly and the noises generated therein have selective ways to be transmitted away. Even if one electrical connector 10 has an unstable contact with the grounding plate 50 and the noises thereof cannot transmitted through original grounding trace, other grounding traces communicating with the original grounding trace still can transmit the noises away and assures the reliable signal transmission. In alternate embodiments, the conductor 30 can fully wrap outer surfaces of the metal shields 131, 132, thereby achieving more reliable mechanical and electrical connection between the conductor 30 and the electrical connectors 10.

Figure 6:
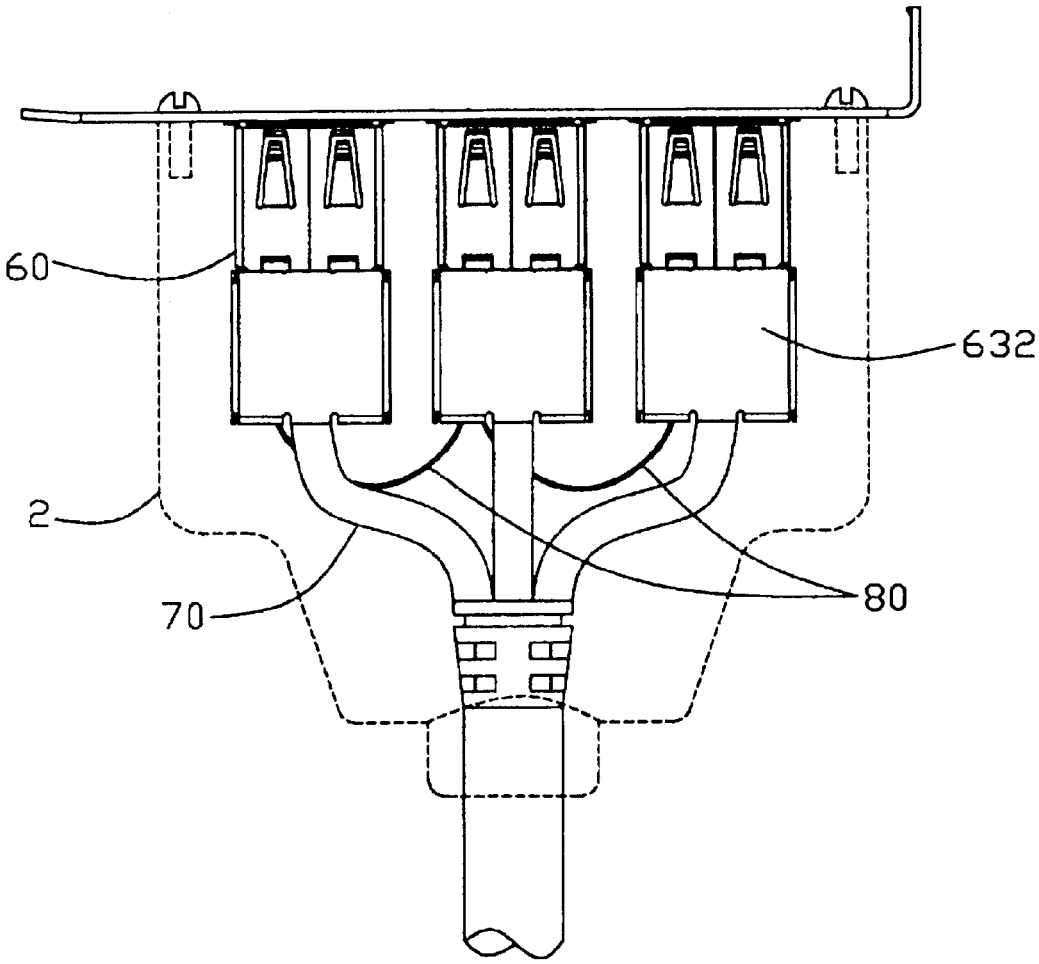
FIG. 6 is a top plan view of a cable end connector assembly in accordance with a second embodiment of the present invention with a cover thereof in a perspective view.
Figure 7:
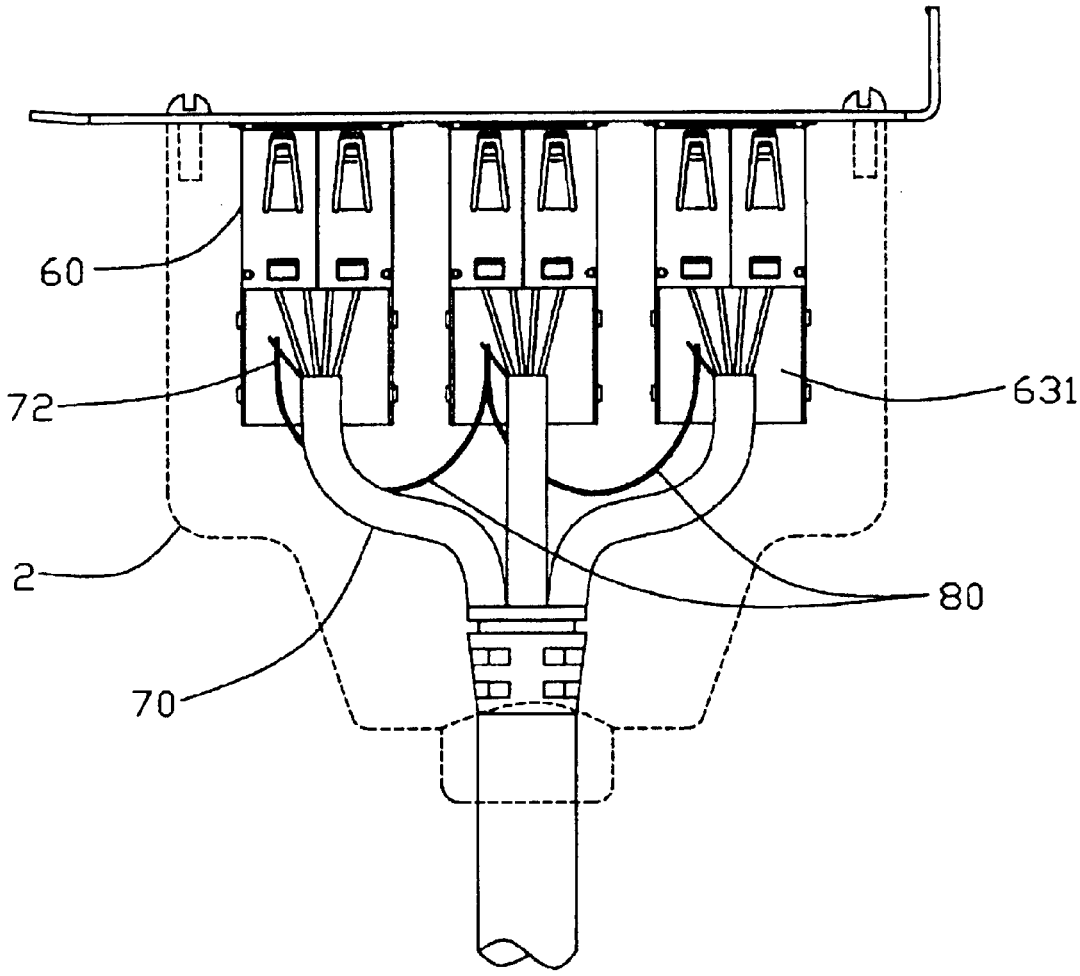
FIG. 7 is a view similar to FIG. 6, with a second metal shield of each electrical connector being removed to show inside structure.

Referring to FIGS. 6 and 7, a second embodiment in accordance with the present invention is shown. A cable end connector assembly 2 has a same construction as that of the cable end connector assembly 1 described in the first embodiment except that a conductor 80 replaces the conductor 30. The conductor 80 is a copper bare wire; The conductor 80 is soldered with the outstretched wires 72 of corresponding cable 70 and the first metal shield 631 of corresponding electrical connector 60 by opposite ends and a middle thereof. In alternate embodiments, the conductor 80 can only be soldered on inner surfaces of the first or second metal shields 631, 632 of the electrical connectors 60, or can be soldered with the outstretched wires 72 of the metal braids of the cables 70. A multi-way grounding trace is thus established.

In addition, the conductor 80 can be a plurality of bare wires, copper half bare wires, or metal sheet, or made of other conductive material.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly, comprising:

a plurality of electrical connectors each comprising an insulative housing, a plurality of contacts mounted in the insulative housing, and a metal shield assembled to the insulative housing;

a cable comprising a plurality of wires electrically connecting with the contacts and a grounding medium electrically connecting with corresponding metal shield;

an insulative cover enclosing the electrical connectors and one end of the cable; and a conductor made of copper foil and wrapping outer surfaces of the metal shields of the electrical connectors to form electrical connection with the metal shields.

2. The cable end connector assembly as claimed in claim 1, wherein the conductor is made of copper foil and soldered on surfaces of the metal shields of the electrical connectors.

3. The cable end connector assembly as claimed in claim 1, further comprising an outer insulative jacket surrounding the wires of the cable, the grounding medium is a metal braid positioned between the wires and the outer insulative jacket.

4. The cable end connector assembly as claimed in claim 3, wherein the metal braid of the cable has a plurality of outstretched wires extending therefrom and being soldered with the metal shields of the electrical connectors.

5. The cable end connector assembly as claimed in claim 4, wherein the conductor is a thin metal wire and is soldered with the metal shield and the outstretched wires of the cable.

6. The cable end connector assembly as claimed in claim 1, wherein a grounding plate is fastened to a front surface of the insulative cover by a plurality of screws.

7. The cable end connector assembly as claimed in claim 6, wherein the grounding plate is long and narrow adapted for electrically connecting with an outer grounding trace, a plurality of openings is defined in the grounding plate and aligns with front surfaces of the metal shields of the cable end connectors for providing mating portions of the electrical connectors extending therethrough, a plurality of holes defined in the grounding plate adapted for the screws protruding therethrough.

8. The cable end connector assembly as claimed in claim 7, wherein the limb of each first grounding terminal further forms a tip in a front end thereof, and the tongue defines a plurality of holes communicating with the passages, the tip of each limb is received in corresponding hole.

9. The cable end connector assembly as claimed in claim 1, wherein the insulative cover is over-molded with the electrical connectors and one end of the cable.

10. A cable end connector assembly comprising:

a plurality of connectors side by side spatially arranged with one another;

a plurality of cables connected to rear ends of the corresponding connectors, respectively;

a cover retainably enclosing the connectors and front ends of the cables;

a rigid grounding plate disposed at a front end of the cover;

each of said connectors including a metallic shell with a front portion electrically contacting the grounding plate; and each of said cables including a metal braid with an outstretched wire mechanically and electrically connected to the shell of the corresponding connector; wherein linking means mechanically and electrically connect to rear portions of the shells of at least every adjacent two connectors.

11. The assembly as claimed in claim 10, wherein said linking means is a metal foil transversely connecting to the rear portions of the shells of all the connectors.

12. The assembly as claimed in claim 10, wherein said linking means is a wire connected between the rear portions of the shells of the every adjacent two connectors.

13. A cable end connector assembly, comprising:

a plurality of electrical connectors each comprising an insulative housing, a plurality of contacts mounted in the insulative housing, and a metal shield assembled to the insulative housing;

a cable comprising a plurality of wires electrically connecting with the contacts and a grounding medium electrically connecting with corresponding metal shield;

an insulative cover enclosing the electrical connectors and one end of the cable;

a conductor electrically and mechanically connecting with the metal shields of the electrical connectors; and an outer insulative jacket surrounding the wires of the cable, the grounding medium is a metal braid positioned between the wires and the outer insulative jacket; wherein the metal braid of the cable has a plurality of outstretched wires extending therefrom and being soldered with the metal shields of the electrical connectors; wherein the conductor is a thin metal wire and is soldered with the metal shield and the outstretched wires of the cable.

* * * * *